US006270196B1

(12) United States Patent
Uno et al.

(10) Patent No.: US 6,270,196 B1
(45) Date of Patent: Aug. 7, 2001

(54) TANDEM TYPE OF DIRECT PRINTING APPARATUS USING GATING APERTURES FOR SUPPLYING TONER

(75) Inventors: Koji Uno, Kobe; Toshio Yamaki, Takatsuki; Hirokatsu Shimada, Machida; Yoshifumi Shibata; Hiroshi Hiraguchi, both of Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/212,206

(22) Filed: Dec. 16, 1998

(30) Foreign Application Priority Data

Dec. 22, 1997 (JP) ..... 9-352798

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 158, 116, 117, 115, 73, 199; 399/271, 290, 293, 294, 295, 184

(56) References Cited

U.S. PATENT DOCUMENTS

| | | | |
|---|---|---|---|
| 5,477,250 | 12/1995 | Larson | 347/55 |
| 5,596,356 | 1/1997 | Lee | 347/55 |
| 5,650,809 | 7/1997 | Kitamura | 347/55 |

*Primary Examiner*—John Banow
*Assistant Examiner*—Raquel Yvette Gordon
(74) *Attorney, Agent, or Firm*—Morrison & Foerster LLP

(57) ABSTRACT

A tandem type direct printing apparatus 2 comprising a plurality of printing stations 16*a*, 16*b*, 16*c* and 16*d* for depositing printing particles 38 on a print medium 8. The plurality of printing stations 16*a*, 16*b*, 16*c* and 16*d* are positioned in a moving direction of the print medium 8. Each printing station 16*a*, 16*b*, 16*c*, 16*d* comprises a bearing member 30 for bearing charged printing particles 38 thereon, a backing electrode 44 opposed to the bearing member 38, a printing head 50 disposed between the bearing member 30 and the backing electrode 44, the printing head 50 having a plurality of apertures 56 through which the printing particles 38 can propel and a plurality of electrodes 68 disposed around the plurality of apertures 56. Each of the plurality of apertures 56 of the printing head 50 in any one of the printing stations 16*b* corresponds to the aperture 56 of the printing head 50 in another printing station 16*a* so that the latter is closest to a line along the moving direction of the printing medium which passes through the center of the former.

5 Claims, 7 Drawing Sheets

TANDEM TYPE OF DIRECT PRINTING APPARATUS USING GATING APERTURES FOR SUPPLYING TONER

This application is based on application No. H9-352798 filed in Japan on Dec. 22, 1997, the content of which is hereby incorporated by reference.

FIELD OF THE INVENTION

The present invention relates to a tandem type of direct printing apparatus for use in a color copying machine and printer.

BACKGROUND OF THE INVENTION

U.S. Pat. No. 5,477,250 issued on Dec. 19, 1995 discloses a tandem type of direct printing apparatus. In the direct printing apparatus, four printing stations are disposed along a sheet moving direction. Each printing station comprises a toner carrier retaining toner on its outer periphery, a backing electrode opposed to the toner carrier and a printing head disposed between the toner carrier and the backing electrode, the printing head having a plurality of apertures and a plurality of electrodes surrounding each aperture. On the outer periphery of the toner carrier in each printing station are retained toner having different colors, for example, magenta, cyan, yellow and black. The backing electrode of each printing station is electrically connected to a power source, thereby between the toner carrier and the backing electrode is formed an electric field for attracting the toner on the toner carrier and propelling it toward the backing electrode through the apertures of the printing head. Between the printing head and the backing electrode in each printing station is formed a passage for a sheet.

When an ON voltage is applied to the electrode of the printing head in the printing station positioned at the most upstream side in the sheet moving direction, for example, the magenta printing station, the toner attracting force due to the electric field between the toner carrier and the backing electrode propels the toner on the toner carrier through the apertures toward the backing electrode and adheres it to the sheet. When an OFF voltage is applied to the electrode of the printing head, the toner attracting force does not affect the toner on the toner carrier, whereby the toner is never propelled. Thus, when ON and OFF voltage applied to the electrode of the printing head are controlled on the basis of a desired image signal, a magenta image corresponding to the image signal is printed on the sheet. In the same manner, by controlling the ON and OFF voltage applied to the electrode of the printing head in each of the downstream printing stations a different color of image is laid on the previously printed image to form a desired image.

In the aforementioned tandem type of direct printing apparatus, as the images formed by the printing stations are overlaid on each other, it is necessary that each aperture of printing head of one printing station corresponds to that of the other printing stations and that the corresponding apertures between the printing stations are aligned on a line parallel to the sheet moving direction. However, each printing station is installed separately from each other. Therefore, the corresponding apertures between the printing stations are shifted in a direction perpendicular to the sheet moving direction (hereinafter referred as a main scanning direction) due to the installation error of the printing head of each printing station. As the position shift of the apertures in the main scanning direction results in color deviation of the image, it is not possible to obtain a clear image.

For example, as shown in FIG. 8, in the case that an installation error of 50 $\mu$m exists between the first printing station 104*a* and the second printing station 104*b* which have six apertures 102 with a pitch of 42 $\mu$m, a position shift or a color deviation of 50 $\mu$m which is same as the installation error is caused between the first aperture 102 of the first printing station 104*a* and the first aperture 102 of the second printing station 104*b*. In order to eliminate such color deviation, after setting the printing head 106 of the second printing station 104*b*, the position of the printing head 106 can be adjusted with high precision so that the installation error become zero. However, as this adjusting work is very difficult, the accuracy obtained by the adjusting work is limited.

SUMMARY OF THE INVENTION

Accordingly, the present invention has been accomplished to solve the aforementioned disadvantages of the prior arts. An object of the present invention is to provide a tandem type of direct printing apparatus in which color deviation is minimized without position adjustment of the printing head.

In order to achieve the aforementioned object, according to the present invention, there is provided a tandem type direct printing apparatus comprising a plurality of printing stations for depositing printing particles on a print medium, the plurality of printing stations being positioned in a moving direction of the print medium, the printing station comprising:

a bearing member for bearing charged printing particles thereon;

a backing electrode opposed to the bearing member;

a power supply connected to the backing electrode for generating an electric field that attract the charged printing particles on the bearing member to propel the same toward said backing electrode;

a printing head disposed between the bearing member and the backing electrode, the printing head having a plurality of apertures through which the printing particles can propel and a plurality of electrodes disposed around the plurality of apertures;

a driver for applying the plurality of electrode with a voltage for allowing the printing particles to be propelled and a voltage for forbidding the printing particles to be propelled in response to an image signal; and a controller for outputting the image signal to the driver;

wherein each of the plurality of apertures of the printing head in any one of the printing stations corresponds to the aperture of the printing head in another printing station so that the latter is closest to a line along the moving direction of the printing medium which pass through the center of the former.

In the tandem type direct printing apparatus of the present invention having such construction as described above, each of the plurality of apertures of the printing head in any one of the printing stations corresponds to the aperture of the printing head in another printing station so that the latter is closest to a line along the moving direction of the printing medium which pass through the center of the former, whereby no position adjusting work of each printing stations is necessary. a quantity of color deviation is reduced to at most half the pitch of the apertures.

Preferably, the number of the plurality of apertures of the printing head in each of the printing stations may be larger than an effective dots number to prevent lack of dot. In this case, the controller may output the image signal as a dummy to the driver so that the electrodes corresponding to the dots over the effective dots number are supplied with a voltage for forbidding the printing particles to be propelled. Moreover, the electrodes corresponding to the dots over the effective dots number may be supplied with a voltage for forbidding the printing particles to be propelled.

Preferably, the bearing member in each of the printing stations may bear the charged printing particles with different color thereon to perform color print.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
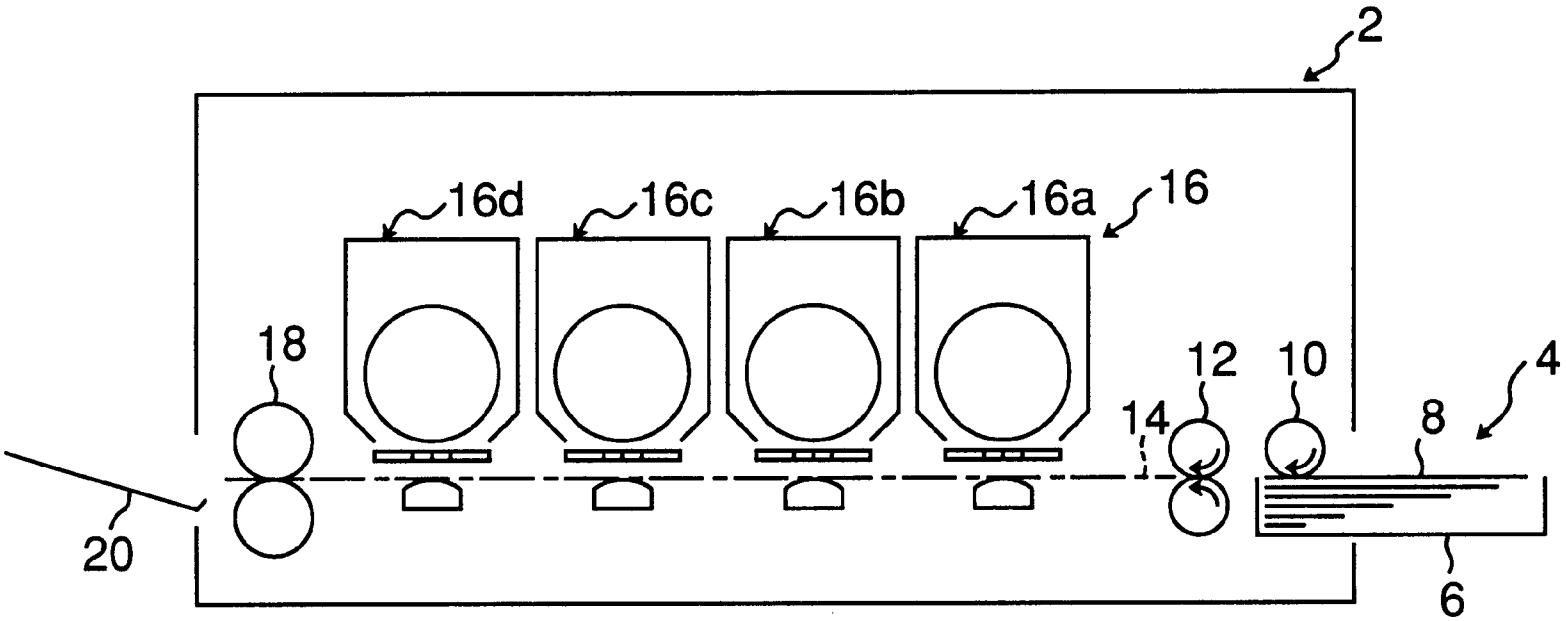
FIG. 1 is a schematic cross-sectional side elevational view of a first embodiment of a tandem type direct printing apparatus of the present invention.

With reference to the drawings and, in particular, to FIG. 1, there is shown a tandem type of direct printing device, generally indicated by reference numeral 2, according to a first embodiment of the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed. The sheet 8 is conveyed along the sheet passage 14 by an unshown transfer belt.

The printing station 16 comprises four printing stations 16*a*, 16*b*, 16*c* and 16*d* equally spaced along the sheet passage 14. These printing stations 16*a*, 16*b*, 16*c* and 16*d* have essentially same construction respectively and therefore one printing station, for example, the printing station 16*a* positioned at the most upstream side in the sheet passage 14 will be explained hereinafter.

Figure 2:
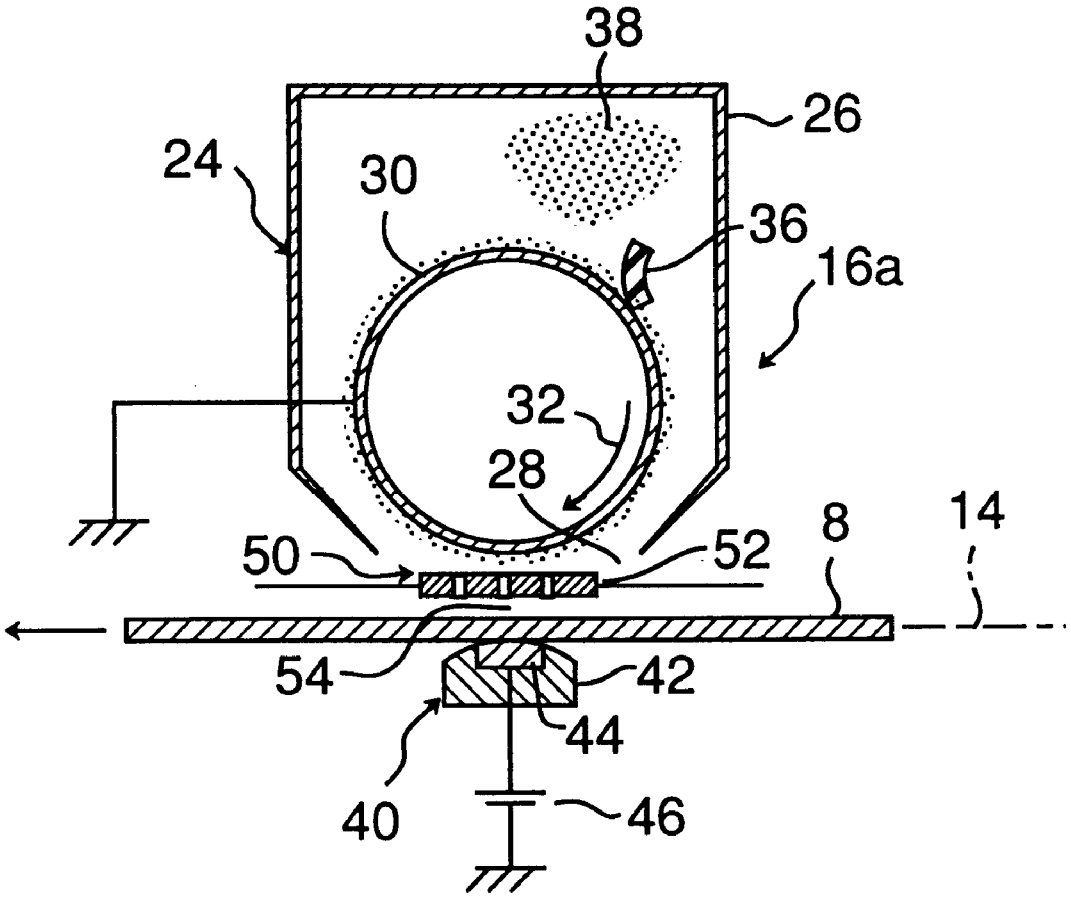
FIG. 2 is a cross-sectional side elevational view of a printing station.

Referring to FIG. 2, the printing station 16*a* comprises a developing device generally indicated by reference numeral 24 above the sheet passage 14. The developing device 24 comprises a container 26 which has an opening 28 confronting the sheet passage 14. Adjacent the opening 28, a developing roller 30 as a bearing member of printing particles according to the present invention is supported for rotation in a direction indicated by an arrow 32. The developing roller 30 is made of conductive material and is electrically connected to the earth. A blade 36, preferably made from a plate of elastic material such as rubber or stainless steel, is disposed in contact with the developing roller 30.

The container 26 accommodates printing particles, i.e., toner particles 38. In this embodiment, the toner particles capable of being charged with negative polarity by the contact with the blade 36 are used. The color of the toner particles 38 at each of the printing stations 16*a*, 16*b*, 16*c* and 16*d* is different from each other. For example, the color of the toner particles 38 is magenta at the printing station 16*a*, cyan at the printing station 16*b*, yellow at the printing station 16*c* and black at printing station 16*d*, thereby color printing is possible.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) so that the backing electrode 44 is provided with, for example, a voltage of +1200 volts. Thus, between the backing electrode 44 and the developing roller 30 are formed an electric field E that the negatively charged toner particles 38 on the developing roller 30 are electrically attracted to the backing electrode 44. The backing electrode 44 comes into contact with the back side surface of the sheet 8 to be conveyed via a transfer belt not shown.

Figure 3:
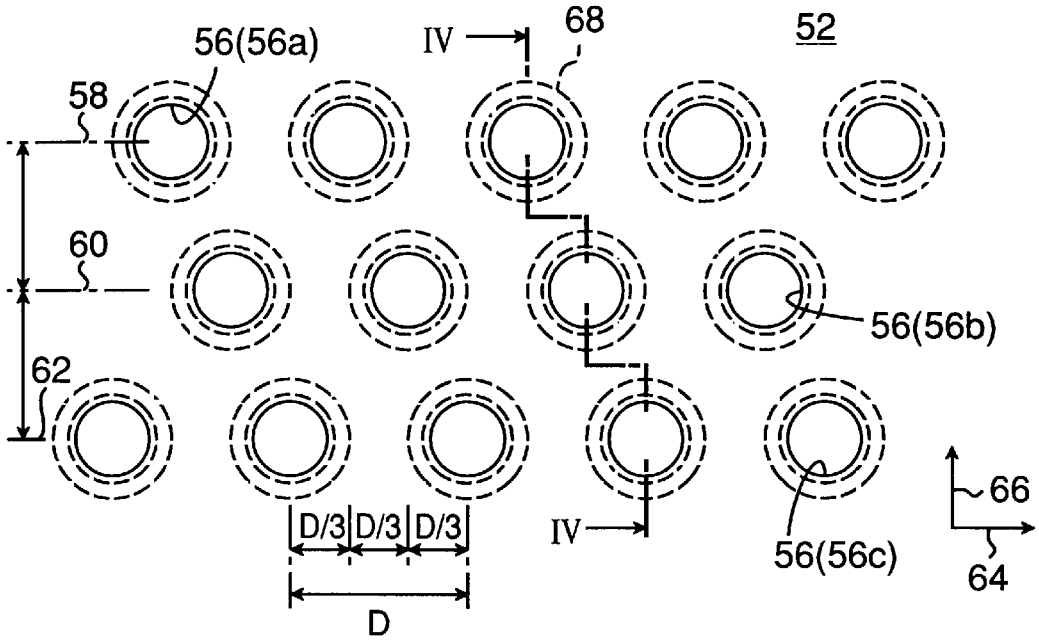
FIG. 3 is an enlarged fragmentary plane view of a printing head.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 50 to 150 micrometers. As shown in FIGS. 2 and 3, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56 (56*a*) and 56 (56*c*) on the lines 58 and 62 are shifted by the distance D/N to the opposite directions with respect the apertures 56 (56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first and second electrodes 68 and 70 each of which surrounding the apertures 56. The first electrode 68 is disposed on one side opposing the developing roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing device 2.

The image signals to be transmitted to the first and second electrodes 68 and 70 consist of a DC component constantly applied to the first and second electrodes 68, 70 and a pulse component applied to the first and second electrodes 68, 70 in response to the image data from the controller 80 for forming dots on the sheet 8.

In the concrete, in this embodiment, for the first electrode 68, the base voltage V1(B) is about −50 volts, and the pulse voltage V1(P) is about +300 volts. For the second electrode 70, the base voltage V2(B) is about −100 volts and the pulse voltage V2(P) is about +200 volts.

Figure 5A:
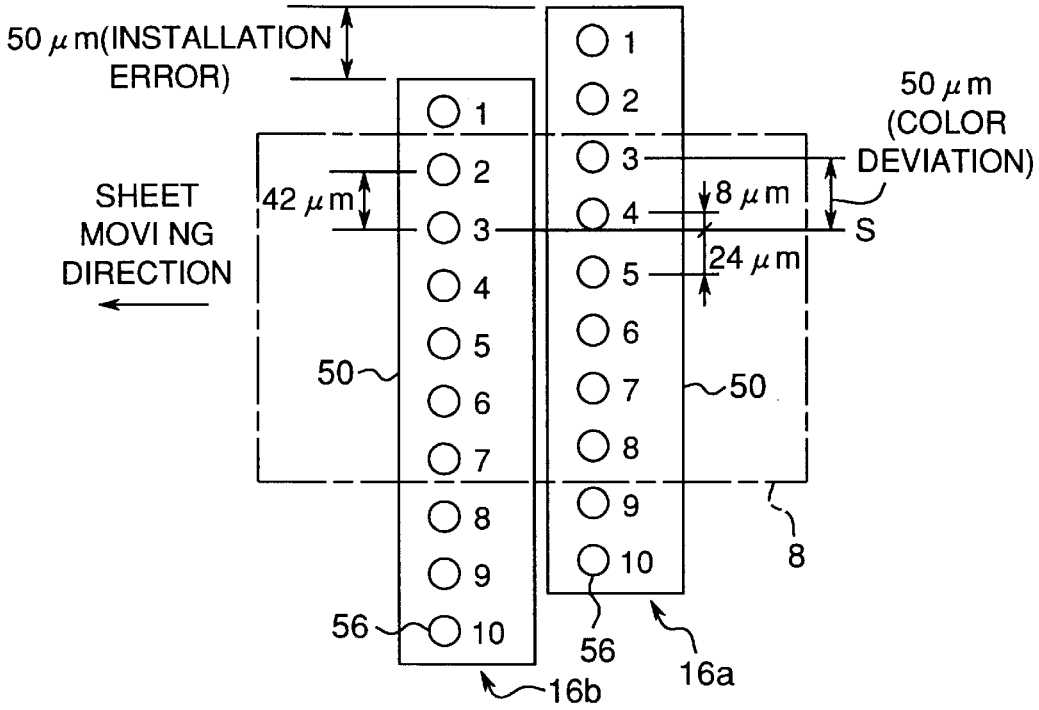
FIGS. 5A and 5B are plane views of the printing heads showing how to make apertures of one printing station correspond to that of the other printing stations.
Figure 5B:
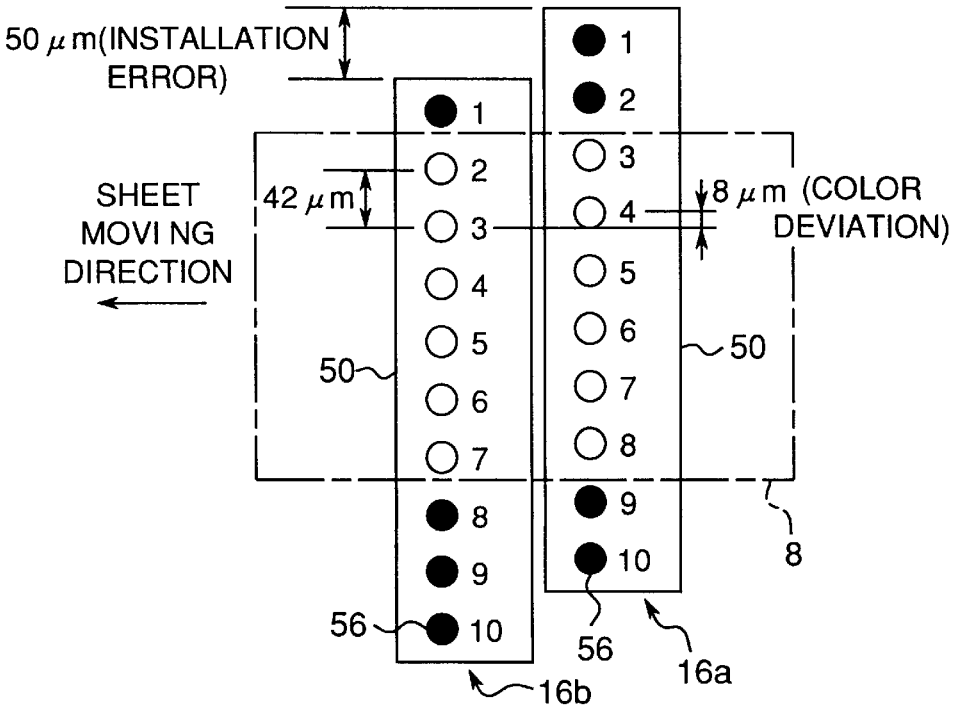

FIGS. 5A and 5B shows how to make the apertures 56 of the printing head 50 of the first printing station 16*a* correspond to that of the second printing station 16*b*. In FIGS. 5A and 5B, only one line of the apertures 56 of the printing heads 50 of the second printing station 16*b* and the first printing station 16*a* are shown and the other lines of apertures 56 is omitted to simplify the drawings. In this FIGS. 5A and 5B, it is supposed that the effective dot number for forming an image within the width of the sheet 8 in the printing stations 16*a*, 16*b* are six (6) respectively, the total aperture number of each of the printing stations 16*a*, 16*b* is larger by four (4) than the effective dot number, i.e. 10 (ten), and the pitch of the apertures 56 is 42 μm.

Now, considering the case that an installation error of 50 μm exists between the second printing station 16*b* and the first printing station 16*a*, a position shift of 50 μm which is same as the installation error is caused between for example the third aperture 56 of the second printing station 16*b* and the third aperture 56 of the first printing station 16*a*. In this condition, upon making the third aperture 56 of the second printing station 16*b* correspond to the third aperture 56 of the first printing station 16*a*, a color deviation of 50 μm is caused, which is not preferable.

So, in this embodiment, it is done to make the third aperture 56 of the second printing station 16*b* correspond to the fourth aperture 56 of the first printing station 16*a*, which fourth aperture 56 is closest to a line S along the sheet moving direction which pass through the center of the third aperture 56 of the second printing station 16*b*. In the same manner, it is also done to make the second, fourth, fifth, sixth and seventh apertures 56 of the second printing station 16*b* correspond to the third, fifth, sixth, seventh, and eighth apertures 56 of the first printing station 16*a*. Moreover, the first eighth, ninth and tenth apertures 56 (painted over with black in FIG. 5B) are unused, while the first ,second, ninth and tenth apertures 56 (painted over with black in FIG. 5B) are also unused. As a result, as shown in FIG. 5B, between the apertures 56 of the second printing station 16*b* and the apertures 56 of the first printing station 16*a*, only a color deviation of 8 μm is caused.

Figure 6:
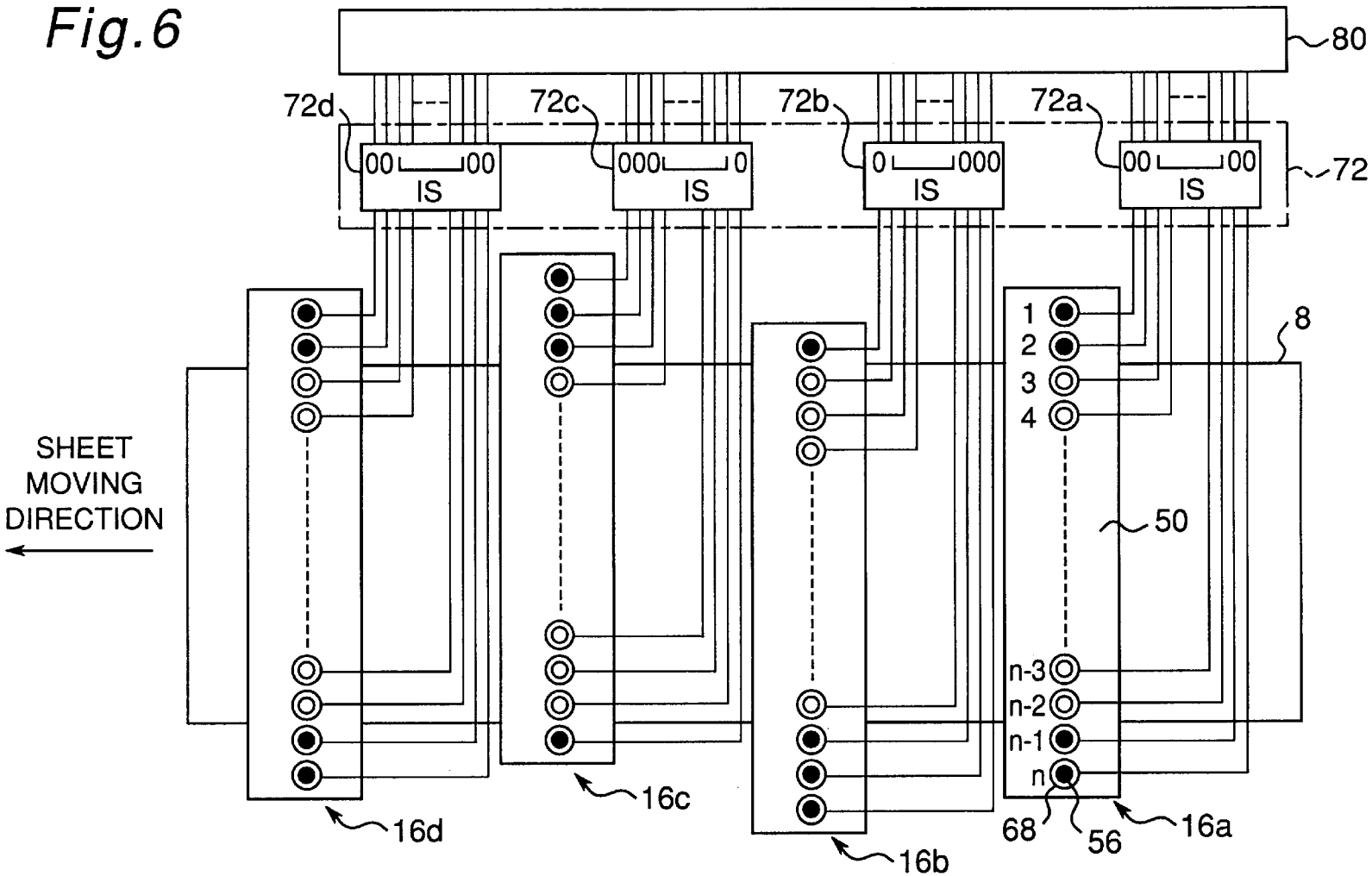
FIG. 6 is a plane view of the printing heads showing an example of wiring condition between the electrodes around the apertures of the printing stations and the drivers.

FIG. 6 shows an example of wiring condition between the first electrodes 68 around the apertures 56 of the printing stations 16*a*, 16*b*, 16*c* and 16*d* and the first drivers 72. Although the explanation will be made hereinafter with regard to the first electrode 68, the second electrode 70 is the same as the first electrode 68. In FIG. 6, each of the printing stations 16*a*, 16*b*, 16*c* and 16*d* has apertures 56 the number of which is larger by four (4) than the effective dot number. Supposing that the first printing station 16*a* is properly installed, the first, second, (n−1)-th and n-th apertures 56 which are positioned at the both side of the first printing station 16*a* are unused. The second printing station 16*b* is installed and shifted to the left side with respect to the first printing station 16*a* when looking at the sheet moving direction and the first, (n−2)-th, (n−1)-th and n-th apertures 56 are unused. The third printing station 16*c* is installed and shifted to the right side with respect to the first printing station 16*a* when looking at the sheet moving direction and the first, second, third and n-th apertures 56 are unused. The fourth printing station 16*d* is installed with almost same accuracy as the first printing station 16*a*, the first, second, (n−1)-th and n-th apertures 56 are unused.

The first electrodes 68 of all apertures 56 in each of the printing stations 16*a*, 16*b*, 16*c* and 16*d* are connected to the output terminals of the drivers 72*a*, 72*b*, 72*c* and 72*d* corresponding to the printing stations 16*a*, 16*b*, 16*c* and 16*d* respectively. To the input terminals of the driver 72*a* corresponding to the output terminals which are connected to the first electrodes 68 of the third to (n−2)-th usable apertures 56 in the first printing station 16*a*, essential image signals IS (0 or 1) are input from the controller 80. To the input terminals of the driver 72*a* corresponding to the output terminals which are connected to the first electrodes 68 of the first, second, (n−1)-th and n-th unused apertures 56, dummy image signals (constantly 0) are input from the controller 80. Similarly, in the drivers 72*b*, 726*c* and 72*d* of other printing stations 16*b*, 16*c* and 16*d*, to the input terminals corresponding to the output terminals which are connected to the first electrodes 68 of the usable apertures 56, essential image signals IS (0 or 1) are input from the controller 80. To the input terminals corresponding to the output terminals which are connected to the first electrodes 68 of the unused apertures 56, dummy image signals (constantly 0) are input from the controller 80.

Thus, to the first electrodes 68 of the usable apertures 56 in the printing stations 16*a*, 16*b*, 16*c* and 16*d*, a voltage of approximately −50 bolts is applied as a base voltage V1(B) when image signal is 0, while a voltage of approximately +300 bolts is applied as a pulse voltage V1(P) when image signal is 1. As a result, image corresponding to the image signal is formed. To the first electrodes 68 of the unused apertures 56, a voltage of approximately −50 bolts is constantly applied as a base voltage V1 (B), whereby no image is formed.

Having described the construction of the printing device 2, its operation will now be described.

Figure 4:
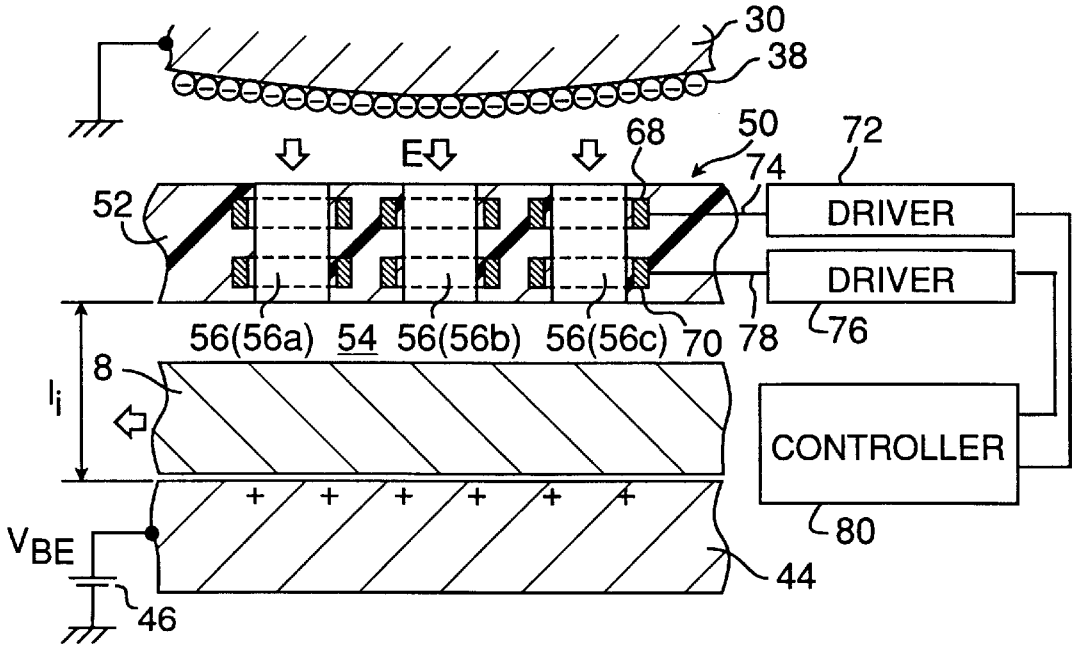
FIG. 4 is an enlarged fragmentary cross-sectional view of the printing head, developing roller and backing electrode taken along a line IV—IV in FIG. 3.

As shown in FIG. 2, in the first printing station 16*a*, the developing roller 30 rotates in the direction indicated by the arrow 32. The toner particles 38 are deposited on the developing roller 30 and then transported by the rotation of the developing roller 30 into a contact region of the blade 36 and the developing roller 30 where the toner particles 38 are provided with triboelectric negative charge by the frictional contact of the blade 36. Thereby, as shown in FIG. 4, incremental peripheral portions of the developing roller 30 which has passed through the contact region bear a thin layer of charged toner particles 38.

In the printing head 50, the first and second electrodes 68 and 70 are constantly biased to the base voltage V1(B) of about −50 volts and V2(B) of about −100 volts. Therefore, the negatively charge toner particle 38 on the developing roller 30 electrically repels against the first and second electrodes 68 and 70 and therefore stays on the developing roller 30 without propelling toward the aperture 56.

The controller 80 outputs the image data corresponding to a magenta image to be reproduced to the drivers 72 and 76. In response to the image data, the drivers 72 and 76 supplies the respective voltages V1(P) of about +300 volts and V2(P) of about +200 volts to the pairs of first and second electrodes 68 and 70. As a result, the toner particles 38 on the portions of the developing roller 30 confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1(P) and V2(P) to base voltages V1(B) and V2(B), at respective timings. As a result, the toner particles 38 in the aperture 56 are then forced radially inwardly by the repelling force from the first and second electrodes 68 and 70 applied with the base voltages V1(B) and V2(B), respectively, and then converged into a mass. The converged mass of the toner particles 38 are then deposited on the sheet f which is moving past the printing zone 54, thereby forming a layer of the magenta toner particles on the sheet 8. The aforementioned second electrode 70 is provided mainly for the purpose of converging the mass of the toner particles 38. Therefore, the second electrode 70 can be excluded if necessary.

In the same manner, in the second printing station 16*b*, a layer of cyan toner particles is formed over the layer of magenta toner particles formed by the first printing station 16*a*. Then, in the third printing station 16*c*, a layer of yellow toner particles is formed over the layer of cyan toner particles formed by the second printing station 16*b*. Finally , in the fourth printing station 16*d*, a layer of black toner particles is formed over the layer of yellow toner particles formed by the third printing station 16*c*. Thus, a desired color image is formed on the sheet 8.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

Figure 7:
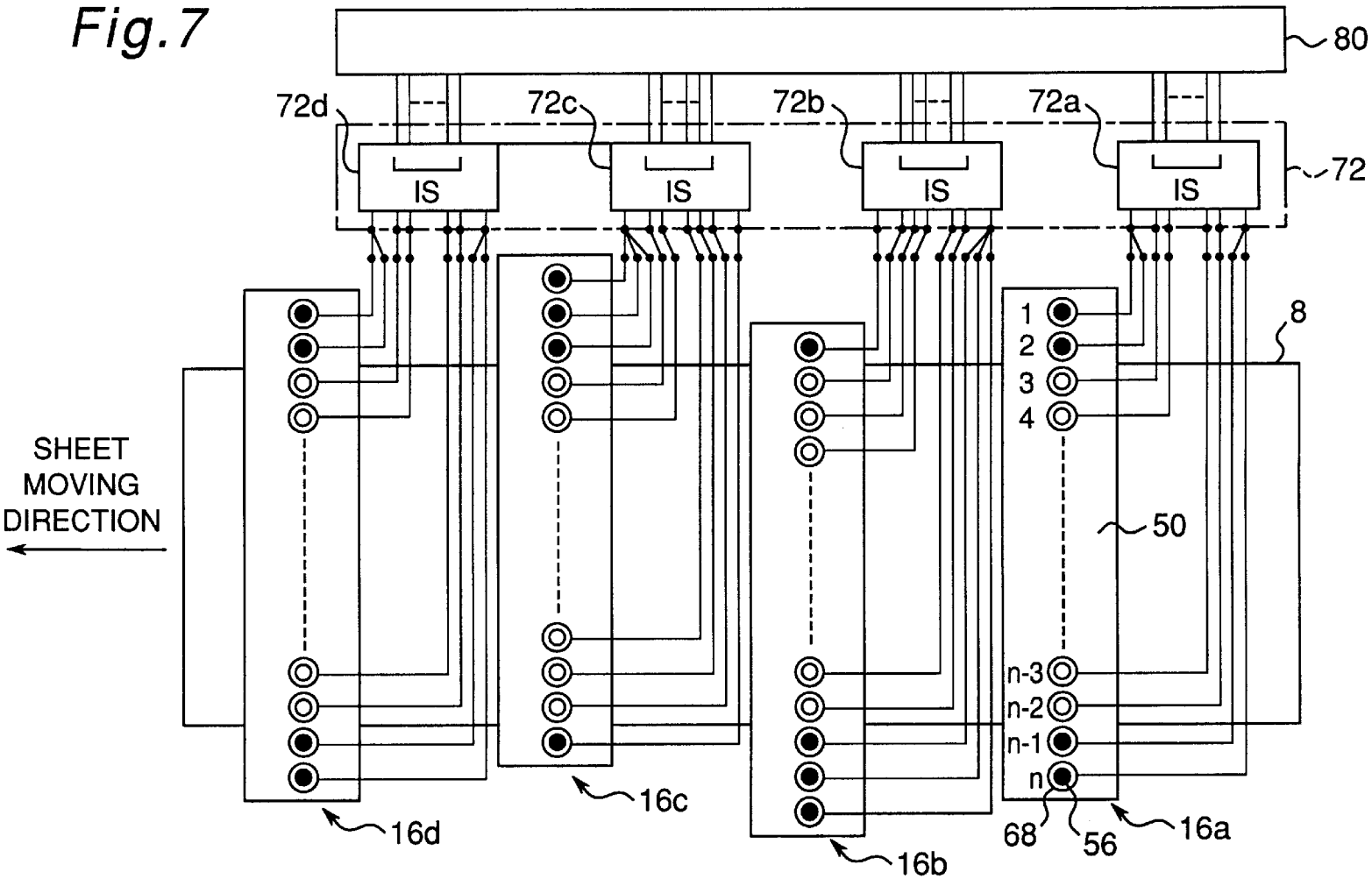
FIG. 7 is a plane view of the printing heads showing another example of wiring condition between the electrodes around the apertures of the printing stations and the drivers.
Figure 8:
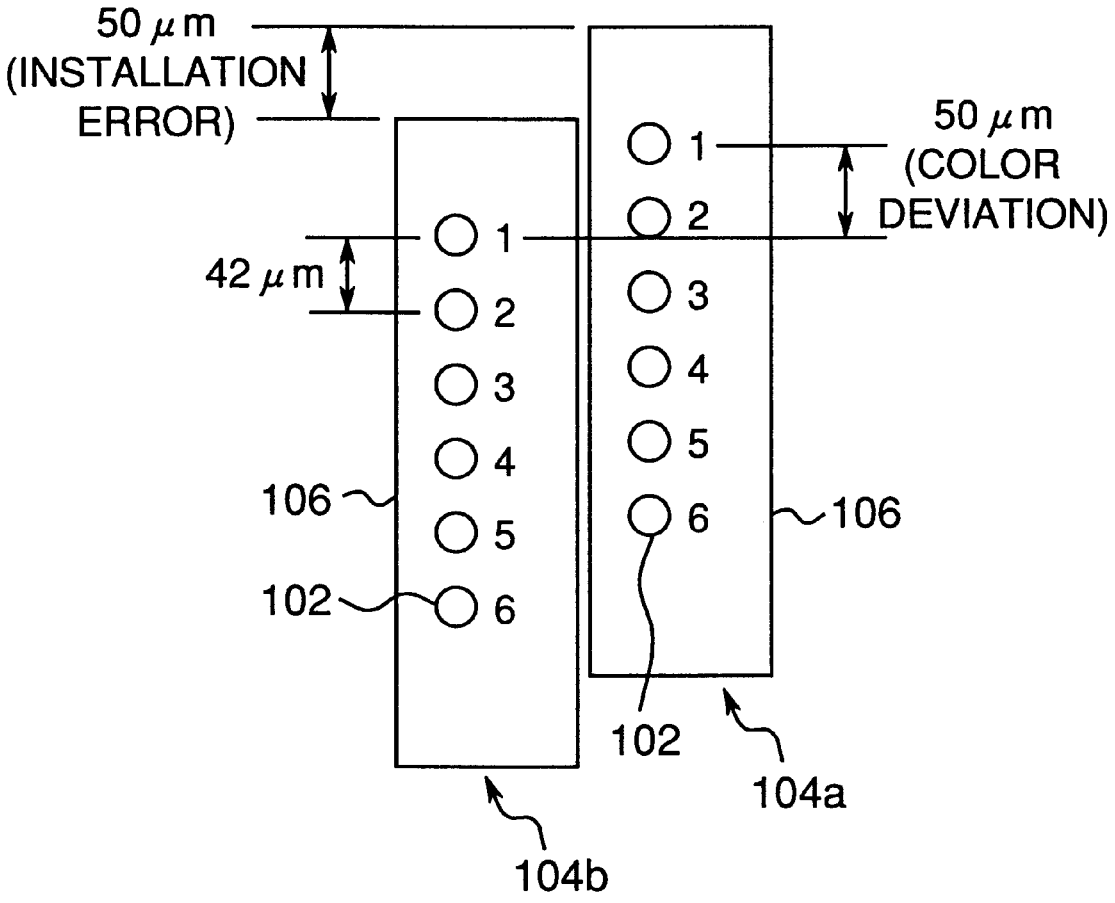
FIG. 8 are plane views of the printing heads in prior art showing how to make apertures of one printing station correspond to that of the other printing stations.

FIG. 7 shows an another example of wiring condition between the first electrodes 68 around the apertures 56 of the printing stations 16*a*, 16*b*, 16*c* and 16*d* and the first drivers 72. The drivers 72*a*, 72*b*, 72*c* and 72*d* of the printing stations 16*a*, 16*b*, 16*c* and 16*d* are provided with auxiliary output terminals for constantly outputting a voltage of approximately −50 volts in spite of image signal as well as the input terminals and the output terminals corresponding to the effective dot number. The first electrodes 68 of the usable apertures 56 in the printing stations 16*a*, 16*b*, 16*c* and 16*d* are connected to the output terminals of the drivers 72*a*, 72*b*, 72*c* and 72*d*, while the first electrodes 68 of the unused apertures 56 are connected to the auxiliary output terminals. Thus, to the first electrodes 68 of the usable apertures 56 in the printing stations 16*a*, 16*b*, 16*c* and 16*d*, a voltage of approximately −50 bolts or a voltage of approximately +300 bolts is applied in accordance with the image signal, whereby image corresponding to the image signal is formed. To the first electrodes 68 of the unused apertures 56, a voltage of approximately −50 bolts is constantly applied as a base voltage V1(B), whereby no image is formed.

It is to be understand that any type of developing device capable of being employed in the electrophotographic image forming apparatus can be used instead of the developing device 24 as shown in FIG. 2 of the direct printing apparatuses 2 in the aforementioned embodiments.

Further, the backing electrode 44 may be a roller made of electrically conductive material.

Furthermore, as a sheet conveying apparatus, an endless belt type of conveying belt or a cylindrical type of conveying drum can be provided. Also, instead of directly printing on a sheet as a printing medium, it is also possible to adhering the printing particles on an intermediate transfer member and then transferring it to a sheet.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A tandem type direct printing apparatus comprising a plurality of printing stations for depositing printing particles on a print medium, the plurality of printing stations being positioned in a moving direction of the print medium, the printing station comprising:

a bearing member for bearing charged printing particles thereon;

a backing electrode opposed to the bearing member;

a power supply connected to the backing electrode for generating an electric field that attract the charged printing particles on the bearing member to propel the same toward said backing electrode;

a printing head disposed between the bearing member and the backing electrode, the printing head having a plurality of apertures through which the printing particles can propel and a plurality of electrodes disposed around the plurality of apertures;

a driver for applying the plurality of electrode with a voltage for allowing the printing particles to be propelled and a voltage for forbidding the printing particles to be propelled in response to an image signal; and a controller for outputting the image signal to the driver;

wherein each of the plurality of apertures of the printing head in any one of the printing stations corresponds to an aperture of the printing head in another printing station so that the aperture is closest to a line along the moving direction of the printing medium which pass through a center of each of the corresponding plurality of apertures.

2. A tandem type direct printing apparatus as claimed in claim 1, wherein a number of the plurality of apertures of the printing head in each of the printing stations is larger than an effective dots number.

3. A tandem type direct printing apparatus as claimed in claim 2, wherein the controller outputs the image signal as a dummy to the driver so that the electrodes corresponding to dots over the effective dots number are supplied with a voltage for forbidding the printing particles to be propelled.

4. A tandem type direct printing apparatus as claimed in claim 2, wherein the electrodes corresponding to dots over the effective dots number are supplied with a voltage for forbidding the printing particles to be propelled.

5. A tandem type direct printing apparatus as claimed in claim 1, wherein the bearing member in each of the printing stations bears the charged printing particles with different color thereon.

* * * * *